United States Patent [19]

Boulton

[11] 4,124,479

[45] Nov. 7, 1978

[54] BIPOLAR UNIT

[75] Inventor: Thomas W. Boulton, Runcorn, England

[73] Assignee: Imperial Chemical Industries Limited, London, England

[21] Appl. No.: 817,676

[22] Filed: Jul. 21, 1977

[30] Foreign Application Priority Data

Aug. 4, 1976 [GB] United Kingdom ..... 32489/76

[51] Int. Cl.[2] ..... C25B 9/00; C25B 11/02; C25B 11/10; C25B 13/08

[52] U.S. Cl. ..... 204/256; 204/288; 204/290 F; 204/296

[58] Field of Search ..... 204/252–266, 204/288, 290 F, 296

[56] References Cited

U.S. PATENT DOCUMENTS

| | | | |
|---|---|---|---|
| 1,907,812 | 5/1933 | Honsberg | 204/252 |
| 3,755,105 | 8/1973 | Messner | 204/256 X |
| 3,882,093 | 5/1975 | Cavanaugh et al. | 204/296 X |
| 3,976,704 | 8/1976 | Vaughan | 204/296 X |
| 3,980,545 | 9/1976 | de Lachaux et al. | 204/254 X |

*Primary Examiner*—John H. Mack
*Assistant Examiner*—D. R. Valentine
*Attorney, Agent, or Firm*—Cushman, Darby & Cushman

[57] ABSTRACT

A bipolar unit for an electrolytic cell comprising (a) an anode comprising a group of elongated members, e.g. wires or rods, of a film-forming metal carrying on at least part of their surfaces an electrocatalytically active coating, the members being electrically conductively mounted on and projecting from a sheet of a film-forming metal so that a part of the members lies in a plane laterally spaced from the sheet, and parallel thereto, and (b) a cathode comprising a group of elongated metal members electrically conductively mounted on and projecting from a metal sheet so that a part of the members lies in a plane laterally spaced from the sheet, the elongated members in at least one of the groups being flexible and the sheets of film-forming anode metal and of cathode metal being electrically conductively bonded to each other.

35 Claims, 4 Drawing Figures

BIPOLAR UNIT

Figure 1:
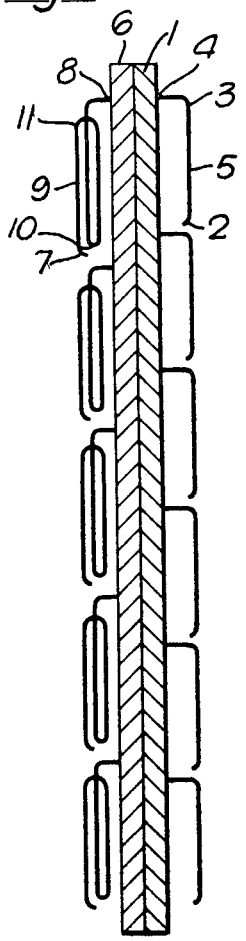

This invention relates to a bipolar unit and to an electrolytic cell incorporating the bipolar unit, particularly an electrolytic cell for the electrolysis of aqueous solutions of alkali metal chlorides.

In operating a diaphragm or membrane cell of the bipolar type, it is advantageous to operate with as small a distance as possible between the anode and cathode (the anode/cathode gap) in order to keep ohmic losses, and hence the cell voltage, to a minimum. In bipolar cells of recent design, the bipolar unit comprises an anode which is suitably in the form of a plate of a film-forming metal, usually titanium, the plate carrying an electrocatalytically active coating, for example a platinum group metal oxide, and a cathode which is suitably in the form of a perforated, e.g. foraminous plate of metal, usually mild steel, the anode and cathode being electrically conductively bonded to each other. The diaphragms or membranes are positioned between successive bipolar units arranged in series in the cell so that the anode of one bipolar unit faces the cathode of the adjacent bipolar unit. The cell also comprises terminal anode and cathode units. The diaphragms or membranes are generally in contact with the foraminous cathode and in order to achieve a small anode-cathode gap without at the same time damaging the diaphragm or membrane it is necessary to exercise considerable care in order to manufacture anodes having a suitable degree of flatness and it is also necessary to maintain this flatness during the heat treatment involved in coating the anode with an electrocatalytically active coating. Furthermore, great care must be exercised in assembling the units in an electrolytic cell if damage to the diaphragms or membranes is to be avoided.

We have now devised a bipolar unit for use in bipolar electrolytic cells which allows very small or even zero anode/cathode gaps to be used in such cells without damage to the diaphragms or membranes, and which can be manufactured without resorting to the considerable accuracy which is required in bipolar units comprising plate anodes.

The present invention provides a bipolar unit for an electrolytic cell comprising (a) an anode comprising a group of elongated members of a film-forming metal carrying on at least part of their surfaces an electrocatalytically active coating, the members being electrically conductively mounted on and projecting from a sheet of a film-forming metal so that a part of the members lies in a plane laterally spaced from the sheet, and (b) a cathode comprising a group of elongated metal members electrically conductively mounted on and projecting from a metal sheet so that a part of the members lies in a plane laterally spaced from the sheet, the elongated members in at least one of the groups being flexible and the sheets of film-forming anode metal and of cathode metal being electrically conductively bonded to each other.

Any suitable metal which is different from the film-forming metal of the anode may be used for the cathode provided, of course, that the metal used for the cathode is conductive and is resistant to the electrolyte used in the electrolytic cell. Suitably the cathode metal is iron or steel and the invention will be described hereinafter with reference to iron or steel as the cathode metal, although other metals, e.g. nickel may be used.

As the elongated members in at least one of the groups are flexible the bipolar units may be assembled in an electrolytic cell with little or no resultant damage to the diaphragm or membrane positioned between the units should the groups of elongated members come into contact with the diaphragm or membrane. If contact is made then damage to the diaphragm or membrane may be reduced or avoided as the elongated members are able to flex towards the sheet of film-forming metal and or towards the sheet of iron or steel as the case may be.

In the bipolar unit it is preferred that a substantial part of each of the elongated members of the anode are laterally spaced from and substantially parallel to the sheet of film-forming metal, and similarly it is preferred that a substantial part of each of the elongated members of the cathode are laterally spaced from and substantially parallel to the sheet of iron or steel.

The parts of the elongated members of film-forming metal which lie in a plane are preferably substantially parallel to each other and similarly the parts of the elongated members of iron or steel which lie in a plane are preferably substantially parallel to each other.

The elongated members of both the anode and the cathode are preferably in the form of wires or rods. The elongated members may be made rigid or flexible by controlling their shape and dimensions, e.g. their thickness. For example, substantially straight wires or rods which are bent at one end near the point of attachment to the film-forming metal sheet (anode) or sheet of iron or steel (cathode) may be essentially rigid, whereas flexibility may be obtained by bending the wires or rods in two or more places, for example to form loops. Also, the greater is the thickness of the wire or rod the greater will be the rigidity of the wire or rod.

A suitable thickness for the wires or rods is in the range 1 to 6 mm, preferably 2 to 4 mm, e.g. 3 mm.

In view of the higher cost of film-forming metal relative to iron or steel and the generally lower conductivity of such metals it is preferred to use elongated members of film-forming metal which are as short as possible. In view of the greater length of elongated member which is generally required to achieve flexibility it is preferred that the flexible elongated members are those on the cathode rather than on the anode. If desired, however, the elongated members of both the anode and cathode may be flexible.

In an especially preferred bipolar unit the elongated members of the anode are substantially rigid and the elongated members of the cathode are flexible. Thus, the elongated members of the anode may each comprise a single bend whereas those of the cathode may comprise two or more bends in the form of a loop.

The elongated members of both the anode and the cathode may be attached to their corresponding metal sheets by welding, for example by use of capacitor discharge welding. In the preferred anode comprising elongated members in the form of wires or rods each member may be bent near one end and attached to the film-forming metal plate by capacitor discharge stud welding. In the preferred cathode, each loop may have a free end which may be attached to the sheet of iron or steel by capacitor discharge stud welding.

In this specification by "a film-forming metal" we mean one of the metals titanium, zirconium, niobium, tantalum or tungsten or an alloy consisting principally of one of these metals and having polarisation properties comparable to those of the corresponding metal. It is preferred to use titanium alone or an alloy based on titanium and having polarisation properties comparable with those of titanium. Examples of such alloys are titanium-zirconium alloys containing up to 14% of zirconium, alloys of titanium with up to 5% of a platinum group metal, e.g. platinum, rhodium or iridium, and alloys of titanium with niobium or tantalum containing up to 10% of the alloying constituent.

The electrocatalytically active coating is a conductive coating which is resistant to electrochemical attack but which is active in transferring electrons between electrolyte and the anode. At least those parts of the elongated members of the anode which are laterally spaced from the sheet of film-forming metal desirably carry en electrocatalytically active coating. If desired the whole of the elongated members and optionally the sheet of film-forming metal may carry an electrocatalytically active coating.

The electrocatalytically active material may suitably consist of one or more platinum group metals, i.e. platinum, rhodium, iridium, ruthenium, osmium and palladium, and/or alloys of the said metals, and/or the oxides thereof, or another metal or a compound which will function as an anode and which is resistant to electrochemical dissolution in the cell, for instance rhenium, rhenium trioxide, magnetite, titanium nitride and the borides, phosphides and silicides of the platinum group metals. The coating may consist of one or more of the said platinum group metals and/or oxides thereof in admixture with one or more non-noble metal oxides. Alternatively, it may consist of one or more non-noble metal oxides alone or a mixture of one or more non-noble metal oxides and a non-noble metal chloride discharge catalyst. Suitable non-noble metal oxides are, for example, oxides of the film-forming metals (titanium, zirconium, niobium, tantalum or tungsten), tin dioxide, germanium dioxide and oxides of antimony. Suitable chlorine-discharge catalysts include the difluorides of manganese, iron, cobalt, nickel and mixtures thereof. Especially suitable electrocatalytically active coatings according to the invention include platinum itself and those based on ruthenium dioxide/titanium dioxide and ruthenium dioxide/tin dioxide/titanium dioxide.

Other suitable coatings include those described in our U.K. patent specification No. 1,402,414 and our U.K. Patent Application No. 49898/73 (Belgian Pat. No. 821,470) in which a non-conducting particulate or fibrous refractory material is embedded in a matrix of an electrocatalytically active material (of the type described above). Suitable non-conducting particulate or fibrous materials include oxides, fluorides, nitrides and sulphides. Suitable oxides, including complex oxides, include zirconia, alumina, silica, thorium oxide, titanium dioxide, ceric oxide, hafnium oxide, ditantalum pentoxide, magnesium aluminate, e.g. spinel $MgO.Al_2O_3$, aluminosilicates, e.g. mullite $(Al_2O_3)_3$ $(SiO_2)_2$, zirconium silicate, glass, calcium silicate, e.g. bellite $(CaO)_2SiO_2$, calcium aluminate, calcium titanate, e.g. perovskite $CaTiO_3$, attapulgite, kaolinite, asbestos, mica, codierite and bentonite; suitable sulphides include dicerium trisulphide, suitable nitrides include boron nitride and silicon nitride; and suitable fluorides include calcium fluoride. A preferred non-conducting refractory material is a mixture of zirconium silicate and zirconia, for example zirconium silicate particles and zirconia fibres.

Those parts of the anodes in the bipolar units of the invention which are to be coated with an electrocatalytically active coating may be coated using a painting and firing technique wherein a coating of metal and/or metal oxide is formed on the anode surface, e.g. on the surface of the elongated anode members, by applying to the surface of the anode members a layer of a paint composition comprising a liquid vehicle and thermally decomposable compounds of each of the metals that are to feature in the finished coating, drying the paint layer by evaporating the liquid vehicle, and then firing the paint layer by heating the coated anode, suitably at a temperature in the range 250° C. to 800° C., to decompose the metal compounds of the paint and form a coating of the desired composition. When refractory particles or fibres are to be embedded in the metal and/or metal oxide of the coating, the refractory particles or fibres may be mixed into the aforesaid paint composition before it is applied to the anode. Alternatively, the refractory particles or fibres may be applied to a layer of the aforesaid paint composition while this is still in the fluid state on the surface of the anode, the paint layer then being dried by evaporation of the liquid vehicle and firing in the usual manner.

The electrocatalytically active coating on the anode of the bipolar unit is preferably built up by applying a plurality of paint layers on the anode, each layer being dried and fired before applying the next layer.

The bonding of the sheet of the film-forming metal to the sheet of iron or steel may be carried out for example by soldering or brazing the sheets together. A particularly suitable method of soldering is that described in our U.K. patent specification No. 1,236,997. In this method the sheet of film-forming metal is coated with a "tinning" metal or alloy by heating the sheet whilst the surface to be coated is covered with a tinning metal or alloy in the molten state and whilst moving an ultrasonically excited probe over substantially the whole of the surface to be coated, the probe being in contact with the surface and with the molten metal or alloy. The coated sheet thus obtained is then soldered to the sheet of iron or steel which has been pre-tinned by conventional means.

The "tinning" metal or alloy is a metal or alloy which will form a coating on a sheet of the film-forming metal or alloy thereof and which will enable the coated sheet thus obtained to be used in a conventional soldering process. Suitable tinning metals include tin, zinc and cadmium. Suitable tinning alloys include binary alloys of tin with zinc, lead, antimony or bismuth and ternary tin-containing alloys, for example a tin/zinc/lead alloy. It is preferred to use a zinc/tin alloy.

In the method the molten tinning metal or alloy is suitably at a temperature in the range 350° C. to 450° C. and the probe suitably resonates at a frequency of approximately 20 Kc/s. For further details of the ultrasonic tinning procedure reference may be made to the aforementioned U.K. patent specification No. 1,236,997.

The pre-tinning of the sheet of iron or steel may conveniently be carried out in the conventional manner by heating the surface to be bonded with for example a lead/tin alloy, or a lead/bismuth alloy. If desired, the tinning metal or alloy may be the same for the tinning of both the film-forming metal sheet and the sheet of iron or steel.

A wide range of alloys may be used for soldering the sheets together. Suitable soldering alloys include, for example, lead/tin alloys or lead/bismuth alloys.

Alternatively, the ultrasonically pretinned sheet of film-forming metal may be bonded to the sheet of iron or steel using an electrically conductive cement as described in our copending U.K. Patent Application No. 51227/73 (Belgian Patent Specification No. 821,727). Any suitable cement may be used, including epoxy resins which are filled with a powder of a conductive metal, e.g. silver or zinc. Generally, the epoxy resins comprise the condensation product of bisphenol-A with epichlorohydrin and the resins may be hardened with a suitable cross-linking agent, e.g. an amine. The cements preferably contain between 50% and 90% by weight of metal. When using such cements it is desirable to apply the cement to the sheets to be bonded then to hold the sheets together under an applied pressure of, for example, 1.4 to 3.5 kg/cm$^2$ whilst the cement is cured, for example at a temperature of 100° C. to 180° C.

In a preferred embodiment of the invention, the sheets of film-forming metal and of iron or steel may be bonded by means of a plurality of copper studs, e.g. pretinned copper studs, the said studs being capacitor discharge stud welded to the sheet of iron or steel, and then soldered to the sheet of the film-forming metal.

According to a further embodiment of the invention there is provided a bipolar cell comprising:

(a) a terminal anode of a film-forming metal having on one surface an electrocatalytically active coating, (b) a terminal metal cathode substantially parallel to said anode, and (c) interposed between said cathode and anode, at least one bipolar unit of the invention, the cathode, the bipolar unit(s) and the anode being disposed in series such that each cathode surface is substantially parallel to and faces but is insulated and spaced apart from an adjacent anode surface by means of a separator thereby forming anode and cathode compartments, said anode compartment being provided with an inlet for electrolyte and outlets for liquids and gases and said cathode compartment being provided with outlets for liquids and gases.

The terminal anode and terminal cathode are preferably of the same design as the anode and cathode parts respectively of the bipolar unit according to the invention.

The separator may be a porous diaphragm or a cation exchange membrane.

Any suitable diaphragm material may be used, but it is preferred to use porous fluoropolymer, e.g. polytetrafluoroethylene, diaphragms. Suitable diaphragms may be prepared from aqueous dispersions of polytetrafluoroethylene and removable filler by the methods described in our U.K. patent specifications Nos. 1,081,046 and 1,424,804. The filler may be removed prior to introducing the diaphragm into the cell, for example by treatment with acid to dissolve the filler. Alternatively the filler may be removed from the diaphragm in situ in the cell, for example as described in our U.K. patent specification No. 1,468,355 in which either acid containing a corrosion inhibitor is used to dissolve the filler or the filler is removed electrolytically.

Alternatively, the diaphragm may be formed from sheets of porous polymeric material containing units derived from tetrafluoroethylene, said material having a microstructure characterised by nodes interconnected by fibrils. The aforesaid polymeric material and its preparation are described in U.K. Patent No. 1,355,373, and its use as a diaphragm in electrolytic cells is described in our copending U.K. Applications Nos. 23275/74 and 23316/74 (Belgian Pat. No. 829,388).

The diaphragm may also be formed by an electrostatic spinning process. Such a process is described in our copending U.K. Application No. 41273/74 (Belgian Pat. No. 833,912) and involves introducing a spinning liquid comprising an organic fibre-forming polymer material, for example a fluorinated polymer, e.g. polytetrafluoroethylene, into an electric field, whereby fibres are drawn from the liquid to an electrode, and collecting the fibres so produced upon the electrode in the form of a porous product or mat.

Any suitable cation exchange material may be used as a membrane. Such materials are generally made of synthetic organic polymeric material on to which have been grafted cation exchange groups, for example sulphonate, carboxylate or sulphonamide groups. In particular, synthetic fluoropolymers which will withstand cell conditions for long periods of time are useful, for example the perfluorosulphonic acid membranes manufactured and sold by E. I. du Pont de Nemours and Company under the trade mark "NAFION" and which are based upon copolymers of tetrafluoroethylene and fluorinated vinyl ethers. Such membranes are described, for example in U.S. Pat. Nos. 2,636,851, 3,017,338, 3,496,077, 3,560,568, 2,967,807, 3,282,875 and U.K. Pat. No. 1,184,321.

Where the cell comprises a cation exchange membrane the cathode compartment will be provided with an inlet for liquid.

The anode/cathode gap is suitably in the range 3 mm to zero preferably 1 mm to zero. Thus, where the anode/cathode gap is zero the elongated members of both the anode and cathode, that is of the anodes and cathodes in the bipolar units or of the terminal anode and cathode, as the case may be, are in contact with the separator.

It is an advantage of the invention when using membranes, for example "NAFION", that the membrane may be supported between elongated members of the anode and the cathode of the bipolar unit or of the terminal anode and cathode, thereby preventing excessive distortion of the membrane when swelling takes place during use in an electrolytic cell.

The bipolar units and the terminal anode and cathode comprising the cell may be held together by any convenient means, for example by means of bolts, clamps, hydraulic or pneumatic jacks.

The bipolar cell is especially useful in the manufacture of chlorine by the electrolysis of aqueous alkali metal chloride solutions, especially sodium chloride solutions.

Figure 2:
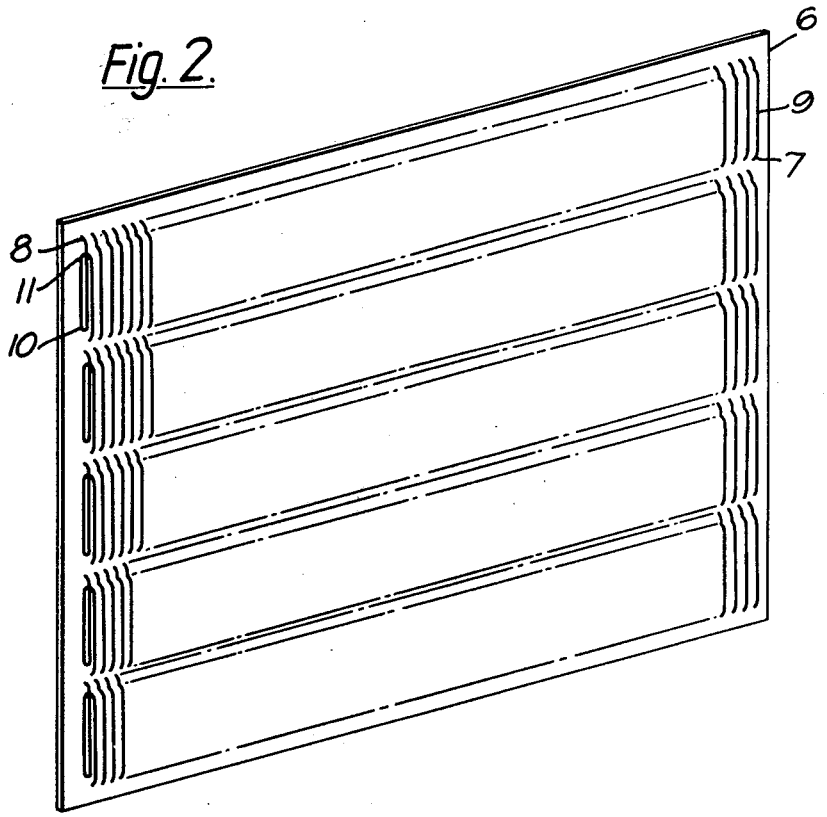
Figure 3:
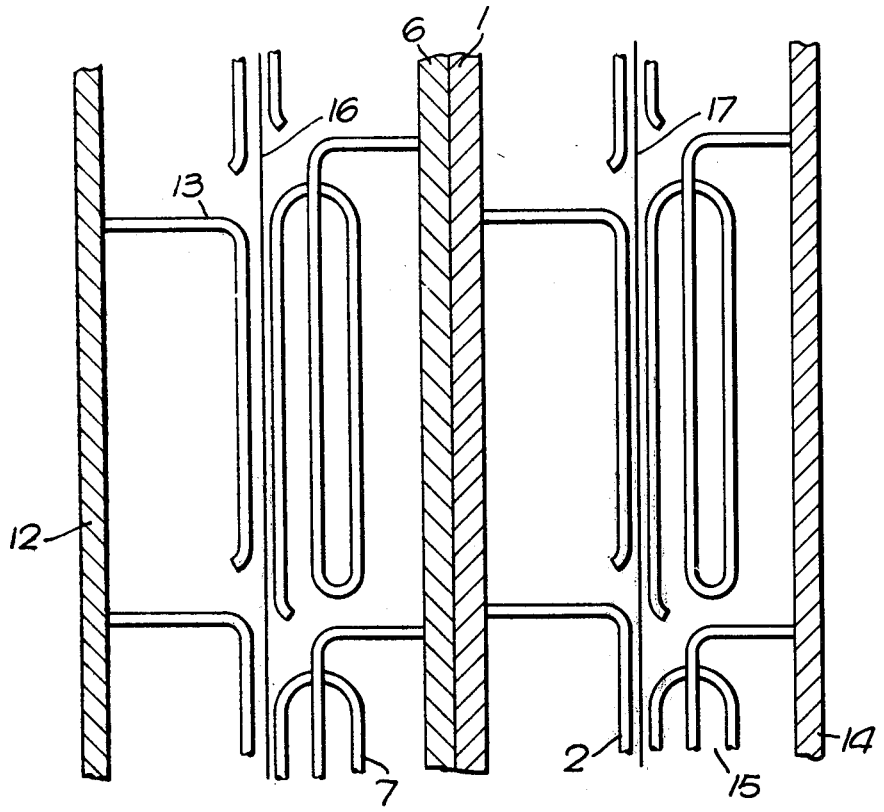

The invention is illustrated in the accompanying drawings in which:

FIG. 1 is an elevation in cross-section of a bipolar unit according to the invention, FIG. 2 is a diagrammatic view of the cathode side of the bipolar unit of FIG. 1, and FIG. 3 is an elevation in cross-section of a part only of an electrolytic cell containing a bipolar unit, a terminal cathode, a terminal anode, and separators between the anodes and cathodes.

Referring to FIG. 1, the bipolar unit comprises an anode consisting of a titanium sheet 1 carrying a plurality of substantially rigid 3 mm thick titanium wires 2 each having a single bend 3 and which are capacitor discharge stud welded at 4 to the sheet 1. Each of the wires 2 has a straight portion 5 parallel to the sheet 1 and laterally displaced therefrom, and the wires 2 are aligned in rows one above the other, so that the straight portions 5 in each row are substantially parallel to each other and lie in a plane. Referring to FIGS. 1 and 2, the cathode part of the bipolar unit consists of a mild steel sheet 6 carrying a plurality of 3 mm thick mild steel wires 7 which are capacitor discharge stud welded at 8 to the sheet 6. The wires 7 have straight portions 9, and have bends 10, 11 forming a loop to give flexibility to the wires. The wires 7 are arranged in rows one above another, so that the straight portions 9 in each row are substantially parallel to each other and lie in a plane.

The titanium anode wires 2 are provided with an electrocatalytically active coating, e.g. ruthenium oxide and titanium dioxide, at least over the straight portion 5.

The back of the titanium sheet 1 is electrically conductively bonded to the mild steel sheet 6 to form a bipolar unit according to the invention. The aforesaid bipolar units are preferably formed by soldering ultrasonically pre-tinned sheets of titanium, e.g. using a zinc/tin alloy, to a pretinned sheet of mild steel.

Referring to FIG. 3 the electrolytic cell contains a bipolar unit of the type described with reference to FIGS. 1 and 2 and comprises a titanium sheet anode 1 which carries a plurality of substantially rigid electrocatalytically active coated titanium wires 2 electrically conductively bonded to a mild steel sheet cathode 6 which carries a plurality of looped flexible mild steel wires 7.

The cell also comprises a terminal titanium sheet anode 12 carrying a plurality of substantially rigid electrocatalytically active coated titanium wires 13 and a terminal mild steel sheet cathode 14 carrying a plurality of looped flexible mild steel wires 15.

A separator 16 is positioned between and may be in contact with the wires of the terminal anode 12 and the wires of the cathode 6 of the bipolar unit, and a separator 17 is positioned and may be in contact with the wires of the terminal anode 14 and the wires of the anode 1 of the bipolar unit thereby forming anode and cathode compartments. The separators may be for example porous diaphragms or cation exchange membranes.

The electrolytic cell shown in FIG. 3 comprises only one bipolar unit of the invention. The cell will generally comprise a plurality of such bipolar units.

The invention is further illustrated by the following Example:

A titanium anode of the same construction as the anode of the bipolar unit shown in FIG. 1 comprised 6 rows of titanium wires 2, with each row containing 32 wires and each wire having a 154 mm long and 3 mm diameter straight portion 5. The wires 2 were capacitor discharge stud welded to the titanium sheet 1 which had dimensions of 300 mm × 970.5 mm. The titanium wires 2 were coated with a mixture of ruthenium oxide and titanium dioxide.

The cathode of the same construction as the cathode shown in FIGS. 1 and 2 comprised 5 rows of looped mild steel wires 7 with each row containing 32 wires which were capacitor discharge stud welded to the mild steel sheet 6.

Figure 4:
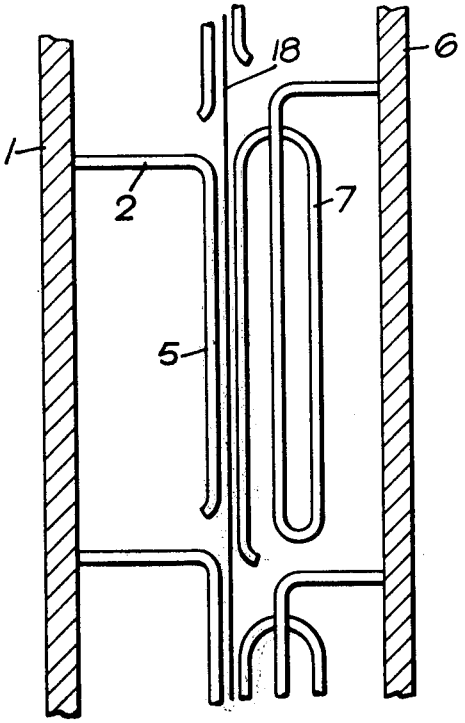

The anode and cathode were assembled into a vertical laboratory membrane cell as shown in FIG. 4 to reproduce under monopolar conditions the performance of the bipolar unit according to the invention. The distances between the titanium sheet 1 and the membrane 18, i.e. the width of the anolyte compartment, and between the mild steel sheet 6 and the membrane 18, i.e. the width of the catholyte compartment, were each 28 mm.

The membrane 18 was a perfluorosulphonic acid membrane based on copolymers of tetrafluoroethylene and fluorinated vinyl ethers "NAFION" ("NAFION" is a Registered Trademark of du Pont). The membrane was adjacent to both the cathode and the anode, i.e. the anode/cathode gap was zero.

Sodium chloride brine (concentration 300 grams/liter of NaCl) was fed to the anolyte compartment at a rate of 6 liters/hour. De-ionised water was added to the catholyte compartment. The temperature of the cell was maintained at 85° C.

A current of 300 amp (equivalent to a current density of 1.8 $kA/m^2$) was passed through the cell. The cell operating voltage was 2.9 volts. The chlorine produced contained 94% by weight of $Cl_2$ and less than 0.1% by weight of $H_2$. The sodium hydroxide produced contained 10% by weight of caustic soda. The cell operated at a sodium hydroxide current efficiency of 86%.

The membrane was undamaged by the wires of the anode and cathode.

What we claim is:

1. A bipolar unit for an electrolytic cell comprising
(a) an anode comprising a group of elongated members of a film-forming metal carrying on at least part of their surfaces an electrocatalytically active coating, each of the members being electrically conductively mounted on and projecting from a sheet of a film-forming metal so that a part of the members lies in a plane laterally spaced from the sheet, and
(b) a cathode comprising a group of elongated metal members electrically conductively mounted on and projecting from a metal sheet so that a part of the members lies in a plane laterally spaced from the sheet, each of the elongated members in at least one of the groups being flexible and being mounted independently of the other members in that group, and said one group comprising a plurality of rows and a plurality of columns of said members and the sheets of film-forming anode metal and of cathode metal being electrically conductively bonded to each other.

2. A bipolar unit as claimed in claim 1 in which the metal of the cathode is iron or steel.

3. A bipolar unit as claimed in claim 1 in which a substantial part of each of the elongated members of the anode are laterally spaced from and substantially parallel to the sheet of film-forming metal.

4. A bipolar unit as claimed in claim 1 in which a substantial part of each of the elongated members of the cathode are laterally spaced from and substantially parallel to the sheet of iron or steel.

5. A bipolar unit as claimed in claim 1 in which the parts of the elongated members of film-forming metal of the anode which lie in a plane are substantially parallel to each other and in which the parts of the elongated members of the cathode which lie in a plane are substantially parallel to each other.

6. A bipolar unit as claimed in claim 1 in which the elongated members of the anode and cathode are in the form of wires or rods.

7. A bipolar unit as claimed in claim 1 in which flexibility in the elongated members is provided by loops in the members.

8. A bipolar unit as claimed in claim 1 in which the elongated members in the group of members on the cathode are flexible and are mounted independently of the other members in the group, said groups comprising a plurality of rows and a plurality of columns of said members.

9. A bipolar unit as claimed in claim 8 in which each of the elongated members in the group of members on the anode are rigid, said group comprising a plurality of rows and a plurality of columns of said members.

10. A bipolar unit as claimed in claim 1 in which the elongated members of the anode are attached to the sheet of film-forming metal by capacitor discharge stud welding.

11. A bipolar unit as claimed in claim 1 in which the elongated members of the cathode are attached to the cathode sheet by capacitor discharge stud welding.

12. A bipolar unit as claimed in claim 1 in which at least those parts of the elongated members which are laterally spaced from the sheet of film-forming metal carry an electrocatalytically active coating.

13. A bipolar unit as claimed in claim 1 in which the film-forming metal is titanium.

14. A bipolar unit as claimed in claim 1 in which the electrocatalytically active coating comprises a mixture of a platinum group metal oxide and a film-forming metal oxide.

15. A bipolar unit as claimed in claim 14 in which the coating comprises a mixture of ruthenium oxide and titanium dioxide.

16. A bipolar unit as claimed in claim 1 in which the sheet of film-forming metal and the sheet of iron or steel are electrically conductively bonded to each other by soldering an ultrasonically pre-tinned sheet of the film-forming metal to a pre-tinned sheet of iron or steel.

17. A bipolar unit as claimed in claim 1 in which the sheet of film-forming metal and the sheet of iron or steel are bonded together by means of a plurality of copper studs.

18. A bipolar electrolytic cell comprising (a) a terminal anode of a film-forming metal having on one surface an electrocatalytically active coating, (b) a terminal metal cathode substantially parallel to said anode, and (c) interposed between said cathode and anode at least one bipolar unit as claimed in claim 1, the cathode, the bipolar unit(s) and the anode being disposed in series such that each cathode surface is substantially parallel to and faces but is insulated and spaced apart from an adjacent anode surface by means of a separator thereby forming anode and cathode compartments, said anode compartment being provided with an inlet for electrolyte and outlets for liquids and gases and said cathode compartment being provided with outlets for liquids and gases.

19. A bipolar cell as claimed in claim 18 in which the metal of the terminal cathode is iron or steel.

20. A bipolar cell as claimed in claim 18 in which the terminal anode and terminal cathode are of substantially the same design as the anode and cathode parts respectively of the bipolar unit.

21. A bipolar cell as claimed in claim 18 in which the separator is a porous diaphragm.

22. A bipolar cell as claimed in claim 21 in which the porous diaphragm is a fluoropolymer.

23. A bipolar cell as claimed in claim 22 in which the fluoropolymer is polytetrafluoroethylene.

24. A bipolar cell as claimed in claim 18 in which the separator is a cation exchange membrane.

25. A bipolar cell as claimed in claim 24 in which the cation exchange membrane is a perfluorosulphonic acid based on a copolymer of tetrafluoroethylene and a fluorinated vinyl ether.

26. A bipolar cell as claimed in claim 18 in which the anode/cathode gap is in the range 3 mm to zero.

27. A bipolar cell as claimed in claim 18 in which the terminal anode comprises a group of elongated members of a film-forming metal carrying on at least part of their surfaces an electrocatalytically active coating, the members being electrically conductively mounted on and projecting from a sheet of a film-forming metal so that a part of the members lies in a plane laterally spaced from the sheet.

28. A bipolar cell as claimed in claim 18 in which the terminal cathode comprises a group of elongated metal members electrically conductively mounted on and projecting from a metal sheet so that a part of the members lies in a plane laterally spaced from the sheet.

29. A bipolar cell as claimed in claim 18 in which a substantial part of each of the elongated members of the anode of the bipolar unit are laterally spaced from and substantially parallel to the sheet of film-forming metal.

30. A bipolar cell as claimed in claim 18 in which a substantial part of the elongated members of the cathode of the bipolar unit are laterally spaced from and substantially parallel to the cathode sheet.

31. A bipolar cell as claimed in claim 18 in which the parts of the elongated members of the film-forming metal of the anode of the bipolar unit which lie in a plane are substantially parallel to each other and in which the parts of the elongated members of the cathode of the bipolar unit which lie in a plane are substantially parallel to each other.

32. A bipolar cell as claimed in claim 31 in which in the bipolar unit the elongated members of the anode and cathode are in the form of wires or rods.

33. A bipolar cell as claimed in claim 32 in which in the bipolar unit flexibility in the elongated members is provided by loops in the members.

34. A bipolar cell as claimed in claim 18 in which in the bipolar unit the elongated members of the cathode are flexible.

35. A bipolar cell as claimed in claim 34 in which in the bipolar unit the elongated members of the anode are rigid and the elongated members of the cathode are flexible.

* * * * *